US011045714B1

(12) United States Patent
Thies

(10) Patent No.: US 11,045,714 B1
(45) Date of Patent: Jun. 29, 2021

(54) COMBINATION BALL RACKING DEVICE FOR POCKET BILLIARDS

(71) Applicant: John Edward Thies, Mohrsville, PA (US)

(72) Inventor: John Edward Thies, Mohrsville, PA (US)

( * ) Notice: Subject to any disclaimer, the term of this patent is extended or adjusted under 35 U.S.C. 154(b) by 0 days.

(21) Appl. No.: 16/946,440

(22) Filed: Jun. 22, 2020

(51) Int. Cl.
*A63D 15/00* (2006.01)

(52) U.S. Cl.
CPC ..... *A63D 15/005* (2013.01)

(58) Field of Classification Search
CPC ..... A63D 15/005; A63D 15/00
USPC ..... 473/40, 41, 21, 26
See application file for complete search history.

(56) References Cited

U.S. PATENT DOCUMENTS 3,672,671 A * 6/1972 Merola ..... A63D 15/005 473/40
4,469,328 A * 9/1984 Pacitti ..... A63D 15/005 473/40
4,984,788 A * 1/1991 Harriman ..... A63D 15/00 473/41
5,376,054 A * 12/1994 Kwasny ..... A63D 15/005 473/40
5,916,032 A * 6/1999 Stoll ..... A63D 15/005 473/40
6,261,187 B1 * 7/2001 Tsai ..... A63D 15/005 473/21
7,166,033 B2 * 1/2007 Krajeski ..... A63D 15/005 473/40
7,785,209 B1 * 8/2010 Targosz, Jr. ..... A63D 15/005 473/40

FOREIGN PATENT DOCUMENTS

GB 2156690 A * 10/1985 ..... A63D 15/005

* cited by examiner

*Primary Examiner* — Mitra Aryanpour

(57) ABSTRACT

A pocket billiards racking device for one or more game configurations. The rack shows a practical, functional, useful and simplified improvement. The design improvements shows a conventional equilateral triangle rack, showcasing a novel set of positional "fences" (i.e., Gates). The Gates, or Fences, incorporated, inset and hinge-pin within the triangular rack, simplifying the setup of the games and streamlining its design.

1 Claim, 4 Drawing Sheets

COMBINATION BALL RACKING DEVICE FOR POCKET BILLIARDS

BACKGROUND OF THE INVENTION

My invention falls in the area of devices used for racking balls for various different games of pocket billiards. Numerous racking devices have been provided in prior art that, for the most part, show a standard triangular form made in one or more pieces (and materials) with three equilateral sides. The prior art cited may or may not show configurations for different games using one device, but not necessarily an efficient, integrated, one-piece design or purpose. While these units may be suitable for a particular purpose to which they address, they would not be as useful or suitable for the purposes of the present invention, as heretofore described. For example, U.S. Pat. Nos. 4,469,328, 5,601,496, and 7,785,209 B1 are all illustrative of such prior art. But, so far as I am aware, the complicated, multi-piece mechanisms suggested in prior patents have not been on sale or met with commercial success.

SUMMARY OF THE INVENTION

It is therefore an object of the present invention to provide an improved, integrated, composite & convertible racking device that accommodates the placement of the balls, for more than one standard game, without substituting an additional rack of differing dimensions for proper and accurate ball placement.

The present ball racking device introduces a novel set of two said positional Fences (i.e., Gates). The said gates, or fences, are integrated into said rack along two adjacent sides, utilizing two said hinge pins, located near one end of each fence member and at the approximate center of each adjacent side of the said triangle rack. The present invention allows the said fences to be accurately and efficiently rotated from a present straight pool, 8-ball or 10-ball setup position in order to play 9-ball without having to change racking devices.

Also (if desired) said fences, once in the open 9-ball position, can be easily nudged forward to contact the already positioned balls in order to further "tighten" the balls (if needed) and then rotate the fences back to again contact the rear side of the said equilateral triangle rack for efficient rack removal.

Further objects of the invention will appear as the description proceeds, these and other features and advantages will be further understood and appreciated by certain novel items of construction, combination and arrangement of parts by those skilled in the art by reference to the following specification, claims and amended drawings.

DETAILED DESCRIPTION OF THE PREFERRED EMBODIMENTS

Figures 1, 2, 3, 4:
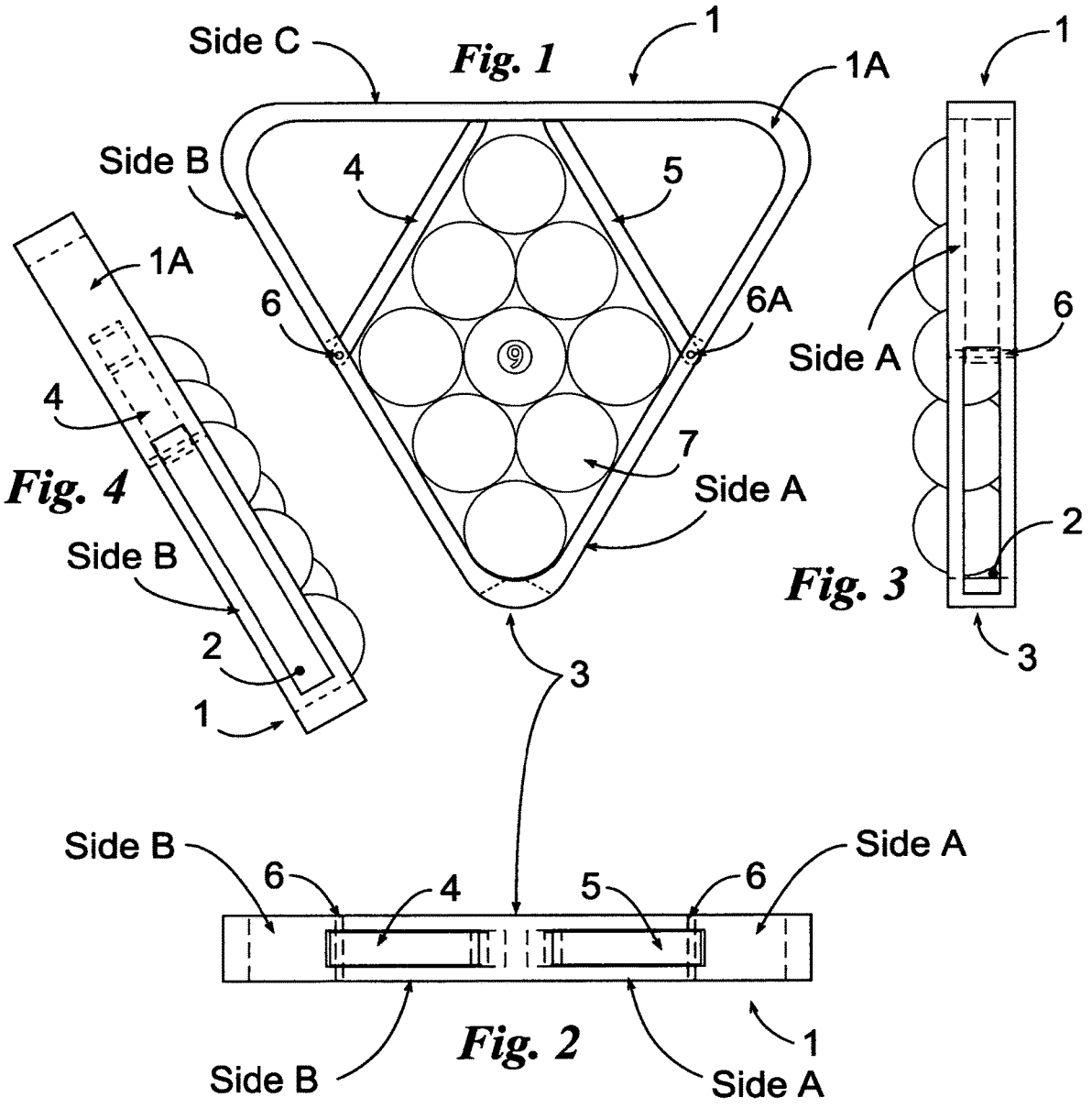
FIG. 1 is a plan view showing my improved pool ball rack with the Fences (i.e., Gates) in the open position, containing 9 pool balls (which are not part of the invention).
FIG. 2 is a front elevation view of FIG. 1 showing an apex of the racking device with said fences in the closed, said straight pool position.
FIG. 3 is a side view (showing Side A) of FIG. 1 showing the said fences in said open position, containing 9 pool balls (which are not part of the present invention).
FIG. 4 is a side "projection" view (showing Side B) of FIG. 1.

Turning now descriptively to the drawings, in which similar reference characters denote similar elements throughout several views, and is the best presently contemplated mode of carrying out the present invention which consists of certain novel features of construction, combination and arrangement of parts as will be fully described and particularly pointed out in the appended claims.

FIGS. 1-4 show a plan, elevation, right Side A and projection views respectively of the improved, useful present invention. Said rack 1 includes an equilateral triangular frame 1A having an apex 3 and three equal and upstanding walls (sides), including walls Side A, Side B and rear wall Side C. Said three walls of frame 1A are joined together at the apex (or machined or cast molded as one piece) with smoothly rounded outside and inside corners. Said inside corners conform closely to a standard pool ball, that is 2¼ inches in diameter.

As best shown in FIGS. 1, 5, 6, & 7 respectively, the improved pool ball rack 1 includes two equal length spaces 2 cut, machined or molded through Side A and Side B, thus providing a hole, as described. Said spaces through said sides start in close proximity to apex 3, continuing within Side A and Side B to approximately the halfway point of each of the two said sides and at a physical cutout size as to snuggly accommodate said fences 4 and 5.

Figure 5:
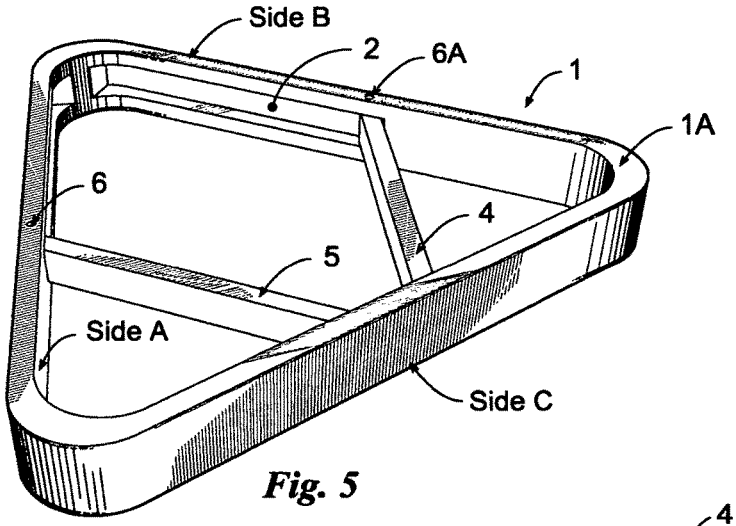
FIG. 5 is a perspective view of said invention, FIG. 1, highlighting Side C, with aforementioned fences in the final, open position.
Figure 5A:
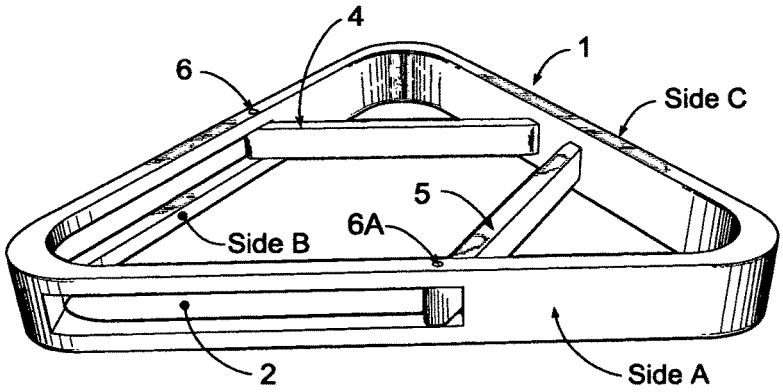
FIG. 5A is a perspective view thereof, showing Side A of said invention.

As shown in all figures aforementioned, said hinge pins 6 and 6A are located vertically through the respective ends of the fences 4 and 5 and also fit through Side A and Side B on the same centerlines as to form rotating members (fences) 4 and 5. Shown specifically in FIG. 7, the fences (gates) are partially rotated, but not yet in final open position. Open positions are shown nicely in FIGS. 1, 5, and 5A. When the fences are in said closed position, illustrated in FIGS. 6, 9 and 10, the fences (i.e., gates) 4 and 5 can be rotated one at a time approximately 120 degrees at which point the unhinged ends of said fences will contact Side C, forming a diamond-shaped space, FIGS. 1, 5, 5A and 8, making it practical and functional to rack for a 9-ball game.

Figure 6:
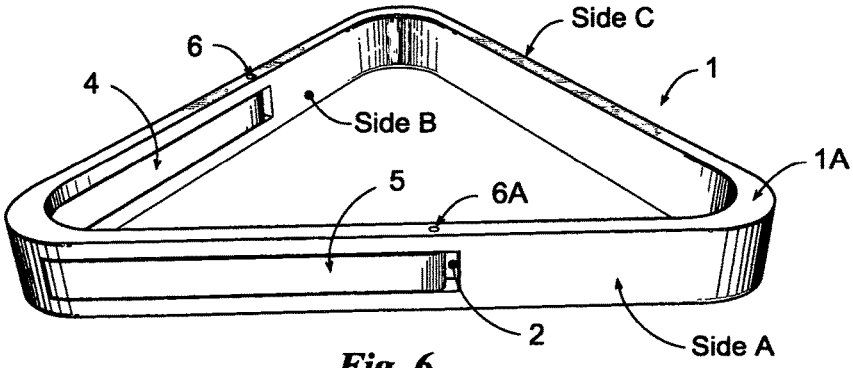
FIG. 6 is a perspective view of said invention, highlighting aforementioned Side A with said fences in the closed position.
Figure 7:
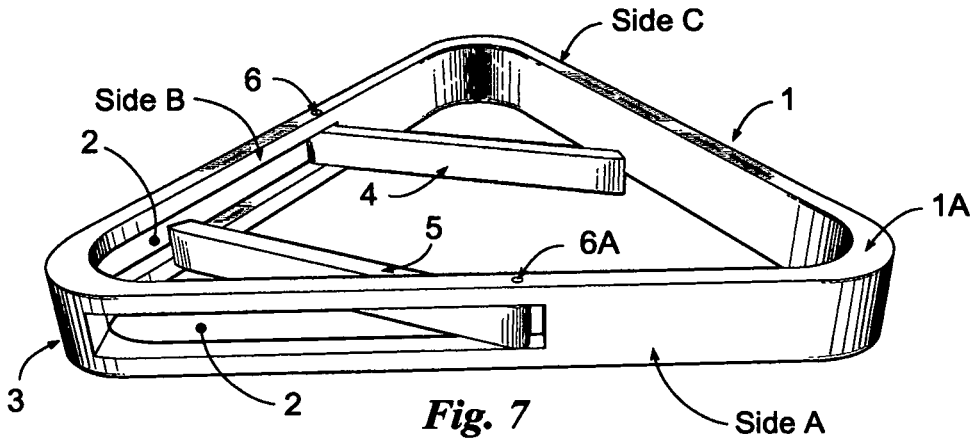
FIG. 7 is a perspective view thereof showing said fences partially rotated.
Figure 8:
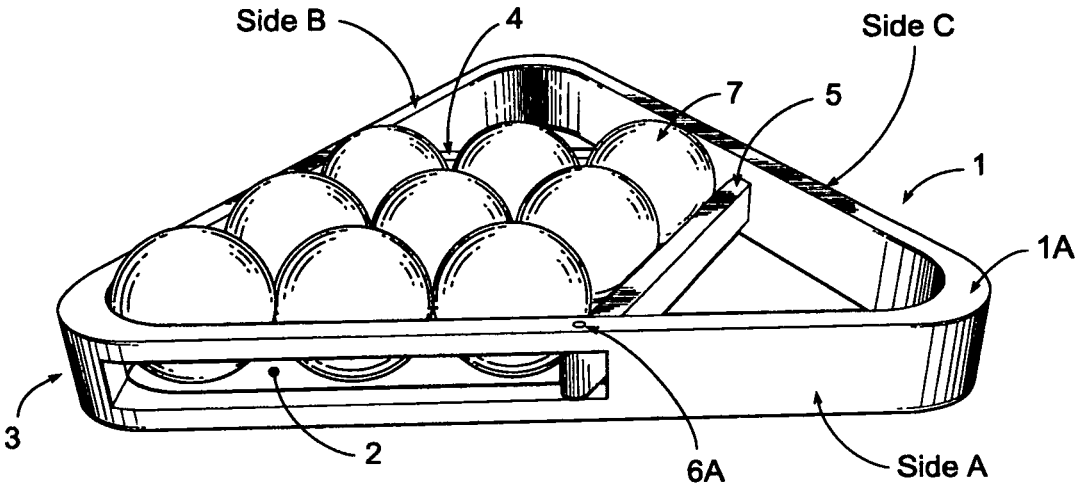
FIG. 8 is a perspective view thereof showing said fences in the aforementioned open and final position containing 9 pool balls (which are not part of the invention).
Figure 9:
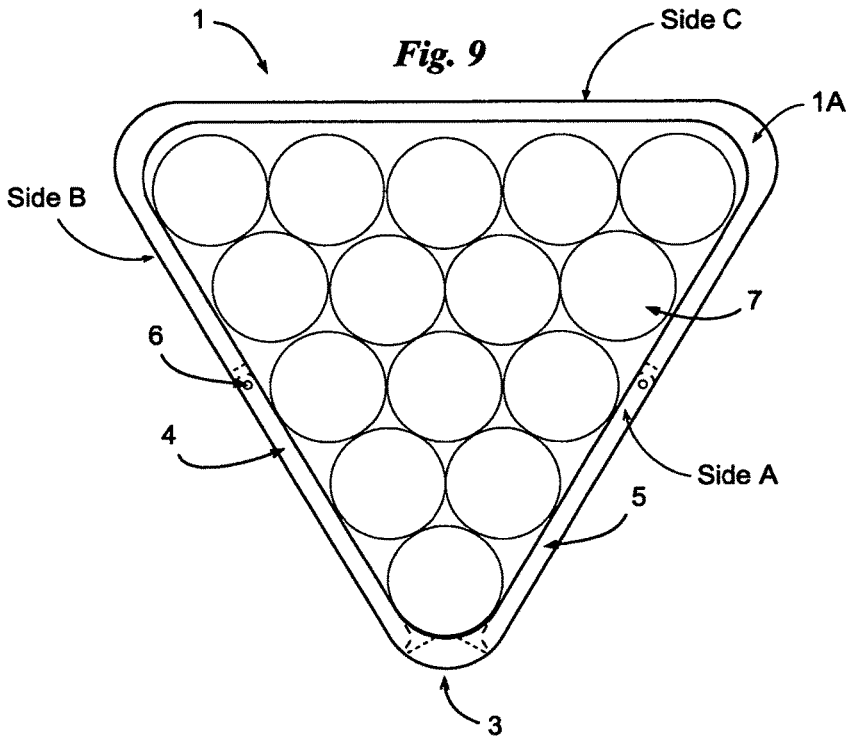
FIG. 9 is a plan view of said invention showing the fences (or gates) in the straight pool (or 8-ball, 10-ball) said closed position, also showing 15 pool balls (which are not part of the invention)
Figure 10:
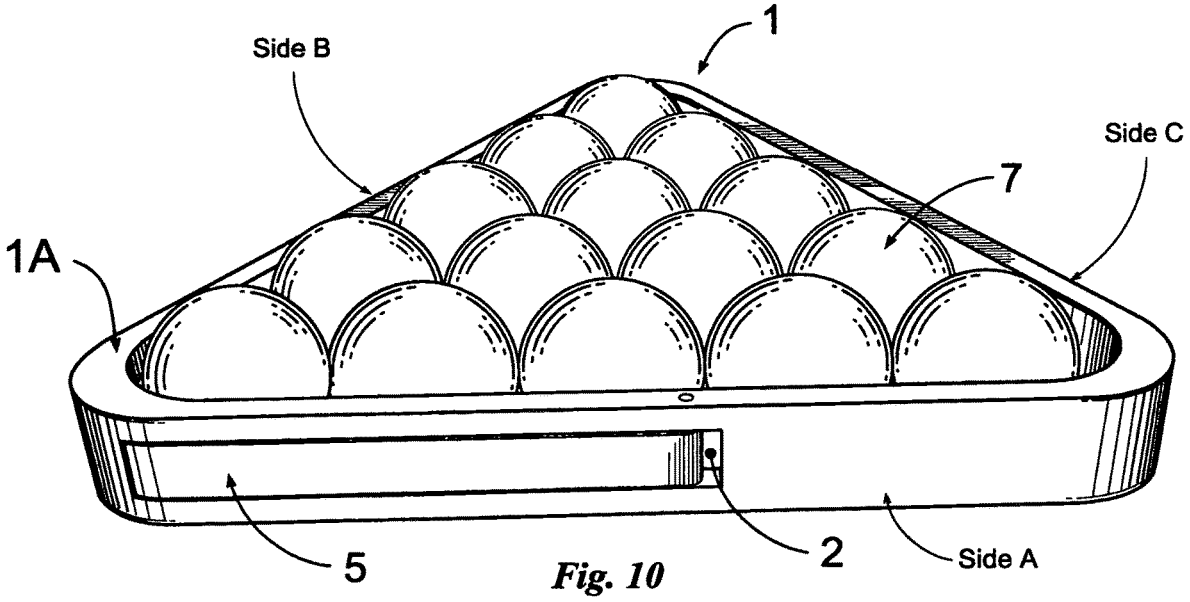
FIG. 10 is a perspective view thereof, highlighting Side A, showing the said fences closed and in the straight pool (8-ball, 10-ball) configuration.

FIGS. 6, 9 and 10 show the fences 4 and 5 in the closed orientation, allowing a maximum of fifteen, 2¼ inch standard pool balls to be racked for various other pocket billiard games to be played. As best shown and visually explained in FIGS. 2 and 8, the present invention, frame 1 is slightly vertically thicker (taller) than any typical equilateral triangle rack. Frame 1 is thicker solely for the purpose of designing (providing) heavier (taller) and more robust fences 4 and 5 to better rack the balls in said open position. The vertically thicker said frame 1 will be stronger and allow a "taller" space, or cutout) to accommodate the snuggly-or tightly-fit (i.e., inherently creates friction fit) fence pieces 4 & 5, and the said hinge pins 6 and 6A respectively.

Having described my invention, what I claim is:

1. A pocket billiards rack for use in games having different number of balls comprising;

an equilateral triangle having first and second sidewalls and an end wall;

first and second longitudinal openings formed within and between an upper and a lower surface of said first and second sidewalls respectively;

first and second gates supported within said first and second openings, said first and second gates frictionally held within said first and second openings;

first and second hinge pins secured within the first and second longitudinal openings and between the upper and lower sides of the first and second sidewalls, said first and second hinge pins pivotally support and move said first and second gates in position;

said first and second walls have sufficient thickness in order to receive and pivotally support said first and second hinge pins and said first and second gates therebetween; and wherein when racking fifteen balls, said first and second gates are placed within the first and second openings, and when racking nine balls, said first and second gates are pivotally moved such that the free-end of the first and second gates frictionally engage the end wall of said billiard rack.

* * * * *